US005976251A

United States Patent [19]

Devine, III et al.

[11] Patent Number: 5,976,251

[45] Date of Patent: Nov. 2, 1999

[54] INLET FOR INTRODUCING WATER TO WIRE EDGE GUIDES FOR CURTAIN COATING

[75] Inventors: William D. Devine, III, Rochester; Douglas B. Humby, Hilton; Kenneth J. Ruschak, Rochester, all of N.Y.

[73] Assignee: Eastman Kodak Company, Rochester, N.Y.

[21] Appl. No.: 09/213,564

[22] Filed: Dec. 17, 1998

[51] Int. Cl.[6] ..... B05B 13/02

[52] U.S. Cl. ..... 118/324; 118/410; 118/DIG. 4

[58] Field of Search ..... 427/420; 118/DIG. 4, 118/325, 410, 411, 324

[56] References Cited

U.S. PATENT DOCUMENTS

| | | | |
|---|---|---|---|
| 3,508,947 | 4/1970 | Hughes | 117/34 |
| 4,830,887 | 5/1989 | Reiter | 427/420 |
| 4,974,533 | 12/1990 | Ishizuka et al. | 118/411 |
| 5,328,726 | 7/1994 | Reiter | 427/420 |
| 5,358,569 | 10/1994 | Conroy et al. | 118/324 |
| 5,382,292 | 1/1995 | Conroy et al. | 118/324 |
| 5,395,660 | 3/1995 | Ruschak et al. | 427/420 |
| 5,725,910 | 3/1998 | Devine et al. | 427/420 |
| 5,763,013 | 6/1998 | Devine et al. | 427/420 |

FOREIGN PATENT DOCUMENTS

WO 94/08272 4/1994 WIPO .

*Primary Examiner*—Brenda A. Lamb
*Attorney, Agent, or Firm*—Arthur H. Rosenstein

[57] ABSTRACT

The present invention is an apparatus for curtain coating a composite layer formed from a plurality of coating compositions onto a moving receiving surface. Edge guides comprising two thin, parallel and closely spaced wires maintain the horizontal extent of the free falling curtain. A flushing and lubricating liquid is supplied to the edge guide. The present invention comprises a distribution body for delivering the flushing and lubricating liquid in laminar flow without initiating stationary waves in the curtain that lead to objectionable coating nonuniformities. The distribution body allows for replacement of the wires without its removal or disassembly. A horizontal conduit near the top of the curtain has an outlet face in contact with the wires that tapers in the upward and downward directions to horizontal edges. The wires pass across the outlet opening within its horizontal diameter. The upper edge of the outlet face positions and supports the wires.

13 Claims, 7 Drawing Sheets

INLET FOR INTRODUCING WATER TO WIRE EDGE GUIDES FOR CURTAIN COATING

FIELD OF THE INVENTION

The present invention relates generally to edge guides for curtain coating apparatus and more particularly to delivering devices for edge guide lubricating liquid for use with curtain coating apparatus.

BACKGROUND OF THE INVENTION

In a curtain coating apparatus, a moving receiving surface is coated by causing a free-falling curtain of coating composition to impinge on the receiving surface to form a layer thereon. One curtain coating apparatus is described in U.S. Pat. No. 3,508,947 to Hughes wherein a composite layer comprising a plurality of distinct layers is formed on a slide hopper and dropped therefrom to form a free-falling curtain. The edges of the curtain must be held to maintain the width of the curtain; otherwise, the curtain narrows as it falls as a consequence of surface tension. To counteract surface tension and maintain curtain width, the curtain is placed in wetting contact with a substantially vertical solid support surface called an edge guide.

In the manufacture of photographic materials comprising many layers, the coated uniformity of the individual layers and the composite layer is critical. Layer uniformity must generally be better than about 2%, and uniformity may have to be significantly better than that over small areas such as a 35 millimeter film frame or over large areas such as the length of a motion picture film.

One source of coating nonuniformity that may occur arises from stationary waves in the curtain. These waves originate at the lateral and top edges of the curtain and propagate laterally into the main body of the curtain. Along the boundary of a stationary wave, the wave speed of propagation of curtain disturbances is in balance with the speed of the falling curtain. Where the wave boundary meets the support being coated, a nonuniformity in the form of a longitudinal streak may be observed in the coated composite layer. More generally, the uniformity of the coated layers can be affected everywhere beneath the wave boundaries. Whether a streak or more diffuse nonuniformity is objectionable depends upon its severity and upon the release specifications for the product.

Standing waves become more common as more layers are coated simultaneously and as the flow rate of the composite layer increases. There is a trend to coat more layers simultaneously to reduce cost and to accommodate new products with additional layers to provide features. There is also a trend to higher coating speeds to reduce manufacturing costs. Therefore, preventing loss of product to objectionable coating nonuniformities from stationary waves is becoming increasingly difficult.

Waves may originate at the hopper lip because of mechanical damage or contamination. Another cause of waves is a discrepancy between curtain trajectory and the profile of the edge guide at the hopper lip. Curtains formed asymmetrically, such as by a slide hopper, do not depart from the lip vertically downward except at low flow rates. More commonly, the curtain abruptly bends backward toward the hopper body at the hopper lip. If the first portion of the edge guide does not accommodate this change of direction, then a stationary wave may arise at the juncture of the edge guide and the hopper lip.

Waves most commonly originate at edge guides because of mechanical damage or their geometric configuration.

Solidification of coating composition on the guide from the congealing or drying of coating composition can initiate waves. Such buildup can be reduced or eliminated by flushing the edge guide with a suitable solvent such as water and controlling ambient conditions including temperature, vapor pressure, and air motions. The low viscosity of the solvent also reduces the drag of the edge guide on the free-falling curtain. Coating latitude is compromised at the edges of the curtain if the velocity there is significantly reduced compared to the main body of the curtain because of drag. Curtain attachment to the full length of the edge guide is also compromised.

Introducing a liquid for flushing and lubricating the edge guide without introducing waves has proven difficult. A poorly configured distribution body can induce waves. Because of the very low viscosity of an effective lubricating liquid, the flow issuing onto the edge guide can be turbulent. Turbulent flow can create traveling waves in the curtain because the turbulent disturbances exciting the waves are moving and transient. If the lubricating liquid jets into the main body of the curtain, waves can also arise, and additional nonuniformity can result as the jet physically displaces the composite layer from the edge guide.

U.S. Pat. No. 4,830,887 discloses a means for introducing lubricating liquid shown in FIGS. 1*a* and 1*b*. The edge guide is a narrow tube, and the liquid is supplied to the top of the tube. The liquid issues from a long, narrow slit in the tube that is in wetting contact with the edge of the curtain. Such a narrow tube is prone to turbulent flow and plugging. Furthermore, tubes have proven less resistant to the formation of stationary waves than dual wires.

U.S. Pat. No. 4,974,533 discloses a means for introducing lubricating liquid shown in FIG. 1*c*. The liquid issues vertically downward from a tube with an opening adjacent to the edge guide. The edge guide is the edge of a plate in wetting contact with the curtain. Such narrow tubes are prone to turbulent flow, and plates have proven less resistant to the development of stationary waves and other edge nonuniformities than dual wires.

Edge guides preferably comprise two thin, parallel, closely spaced wires lying in a plane perpendicular to the hopper lip as disclosed in U.S. Pat. No. 5,328,726. The wires are supported only at the top and bottom of the edge guide. Wire edge guides have proven generally superior for curtain coating and in particular have demonstrated resistance to forming standing waves. Damaged wire is cheaply replaced. Flushed wire edge guides economically and practically solve the problems of buildup and drag. For distributing lubricating liquid to the wires, U.S. Pat. No. 5,328,726 teaches the use of a conduit with an opening directed vertically downward that encompasses the wires as shown in FIG. 1*d*. Again, so small a conduit is prone to turbulent flow. Additionally, running wires through the conduit complicates their replacement. The configuration is also prone to initiating a stationary wave at the lowermost and innermost edge of the distribution body, as shown in FIG. 2.

U.S. Pat. No. 5,358,569 teaches the use of a gradually curved conduit encompassing the wires with an opening directed vertically downward as shown in FIG. 1*e*. This reference teaches how to size the conduit and how to restrict its curvature to ensure laminar (i.e. not turbulent) flow. Running the wires through the conduit complicates their replacement. The configuration is also prone to initiating a stationary wave at the lowermost and innermost edge of the distribution body, as shown in FIG. 2.

U.S. Pat. No. 5,382,292 teaches supplying dual wire edge guides from small channels open to the atmosphere rather than from a conduit as shown in FIG. 1*f*. The channels provide laminar flow and allow time for the action of any surfactant in the lubricating liquid. The wires are more readily accessible for replacement. However, this distribution body may still initiate a stationary wave at the lowermost and innermost edge of the distribution body, as shown in FIG. 2.

SUMMARY OF THE INVENTION

It is, therefore, an object of the present invention to provide curtain coating apparatus for supplying a dual wire edge guide with lubricating liquid without creating a stationary wave in the curtain causing objectionable coating nonuniformities.

It is a further object of the invention to provide curtain coating apparatus for dual wire edge guides that issues the lubricating liquid onto the edge guide in laminar flow.

Still another object of the present invention is to provide curtain coating apparatus for dual wire edge guides that does not have to be removed or disassembled to replace the wire.

The foregoing and other features, objects and advantages of the present invention will become apparent upon a reading of the detailed description, claims and drawings set forth herein. These features, objects and advantages are accomplished by providing curtain coating apparatus wherein the lubricating and flushing liquid is supplied through a straight, horizontal conduit of constant cross section with axis lying in a plane parallel to that of the curtain. The outlet of the conduit is in nominal contact with the dual wires and is centered upon them. The outlet is sufficiently broad, from about 2 millimeters to 4 millimeters, that it extends significantly beyond the outermost edges of the wires. The face of the outlet contacting the wires is planar. The extent of the face in the horizontal direction is nominal, but the face tapers in both the upward and downward directions. The uppermost edge of the face is horizontal and supports the wires. The lowermost edge of the face is horizontal and of length equal to or less than the horizontal span of the outermost edges of the wires. All wetting contact between the distribution body and the curtain occurs within about 1 centimeter of the top of the curtain.

BRIEF DESCRIPTION OF THE DRAWINGS

The foregoing and other objectives, features, and advantages of the invention will be apparent from the following more particular description, including the presently preferred embodiments of the invention, as illustrated in the accompanying drawings in which.

DETAILED DESCRIPTION OF THE INVENTION

Figure 3:
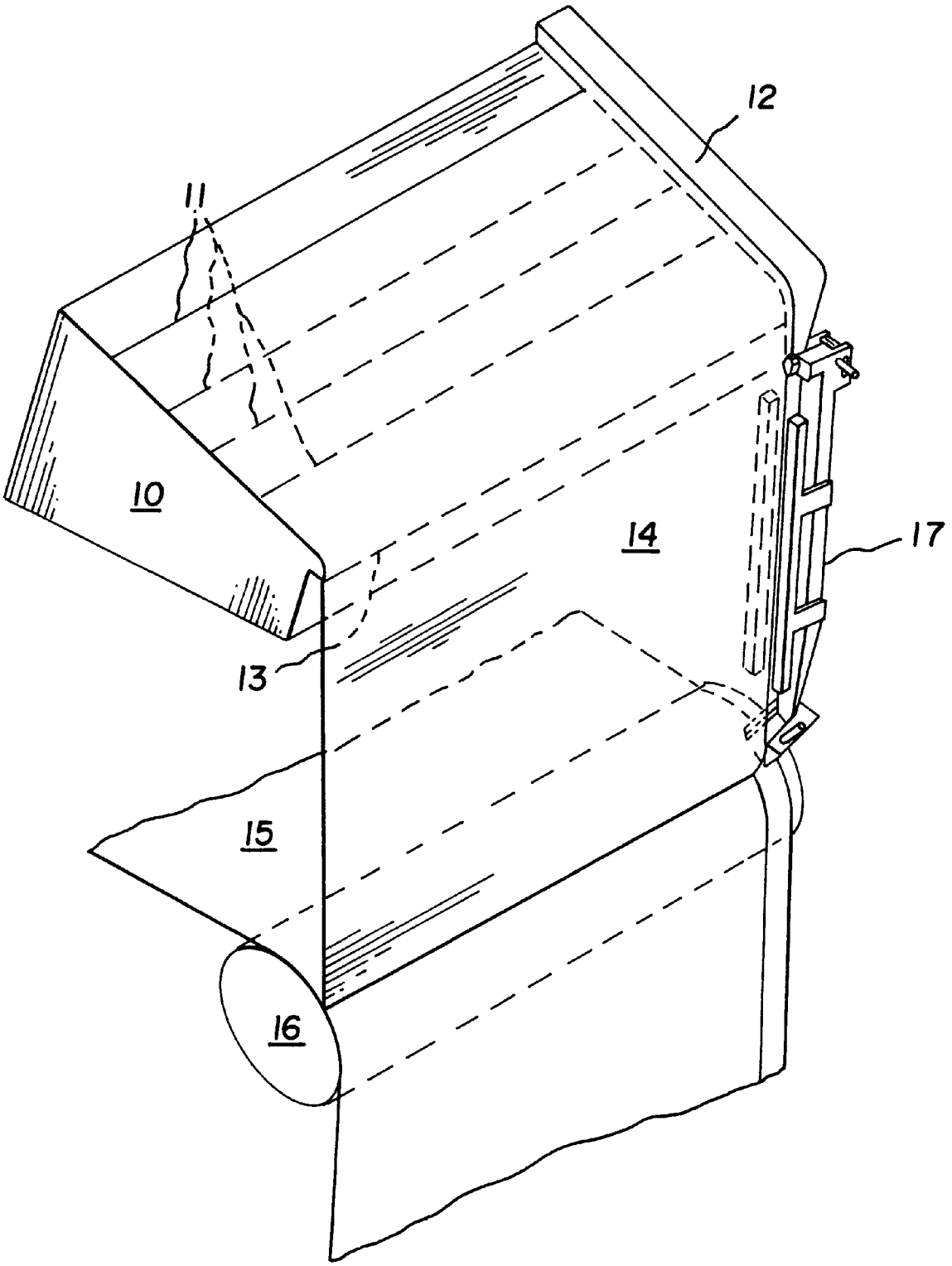
FIG. 3 is a perspective, schematic view of a right portion of a slide-hopper curtain coating process.

The hopper 10 shown in FIG. 3 is a slide hopper for forming a composite layer of one or more coating compositions. The hopper has multiple slots 11 that emit coating composition onto an inclined surface of the hopper called a slide. The coating compositions flow down the slide surface by gravity to hopper lip 13. Edge pads 12 constrain the coating compositions to the hopper slide (EPO Application No. 92 921 499.7-2108). The composite layer detaches from the lowest edge of lip 13 to form a freely falling curtain 14. The edge is straight and horizontal. The free-falling curtain impinges on a moving receiving surface 15 backed by a coating roller 16. While the receiving surface is often a continuous web, it may comprise the surface of discrete objects passed through the curtain on a conveyor belt. Extending downward from the hopper lip are the left and right edge guides 17, with the right edge guide being shown in FIG. 3. The right portion of a curtain coating apparatus is shown in FIG. 3. The left portion (not shown) is a mirror image. These maintain the width of the free-falling curtain; in their absence, the curtain contracts as it falls through the influence of surface tension. The wetted surface of an edge guide lies in a plane passing through the hopper lip. However, in a vertical plane that is perpendicular to the hopper lip, the wetted surface of an edge guide may be inclined as much as 4° from vertical to follow the trajectory of the free-falling curtain. Except at the lowest flow rates, the curtain abruptly bends back towards the hopper body at the hopper lip, and as a result a curved trajectory is established.

Figure 4:
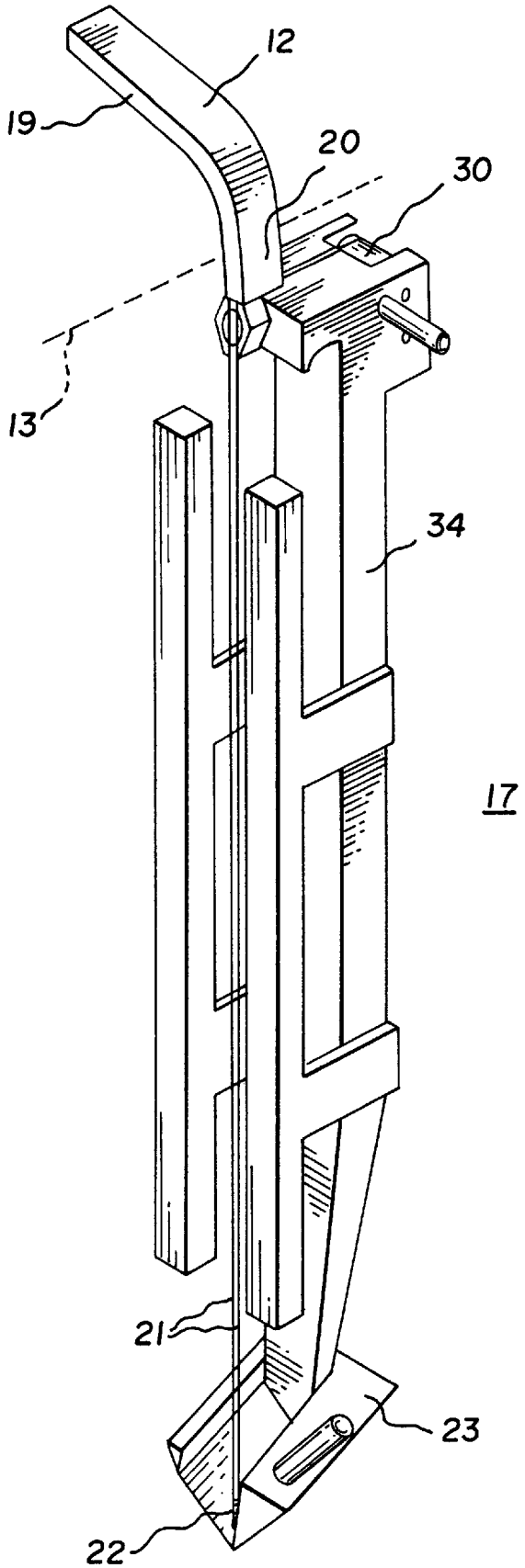
FIG. 4 is a perspective, schematic view of the isolated right-side edge guiding hardware of a curtain coating apparatus incorporating the lubricating liquid distribution body of the present invention.

An edge pad 12 affixed to the slide hopper determines the lateral extent of the layers on the slide as shown in FIG. 4. The pad has a guiding sidewall 19 in wetting contact with the layers on the slide. The edge pad extends at least to the hopper lip and preferably a small distance beyond. The portion 20 of the edge pad projecting below the lip, sometimes called a flag, is shaped to follow any abrupt change in curtain trajectory occurring at the lip. The guiding sidewall of the projecting portion of the pad lies in a vertical plane that is perpendicular to the lip but in that plane may be inclined up to about 30 degrees from vertical to follow the initial backward trajectory of the curtain. The preferred vertical length of the projecting portion 20 of the edge pad can be about 3 millimeters. The projection may be a separate piece, but preferably the connection to the edge pad is seamless or at least smooth. We observe that sensible discontinuities in the guiding sidewall 19 near the hopper lip create curved menisci that in turn adversely affect the uniformity of the layers at the edge and initiate potentially damaging stationary waves in the curtain.

The preferred edge guide comprises two thin wires or strings under tension. Typically the wires 21 are smooth and about 0.2 millimeter in diameter, as braided or rough wires may initiate stationary waves in the curtain. Metal wire may be one of any number of pure or alloyed metals including stainless steel and tungsten. The two wires are substantially parallel and lie in a vertical plane that is perpendicular to the hopper lip. A typical spacing of the wires is such the horizontal span of the outermost edges is about 0.5 to about 1.5 millimeters and preferably, 0.8 millimeter. At the bottom of the edge guide, the wires are supported and spaced by a grooved pin 22; in fact, a single wire preferably turns about the pin to form the two wires of the edge guide. The thin wire preferably employed accommodates such sharp changes of direction.

Optionally, a blade/vacuum port combination 23 at the base of the edge guide, as disclosed in U.S. Pat. Nos. 5,395,660, 5,725,910 and 5,763,013, allows for the removal of the lubricating liquid and some small portion of the main curtain. This removal can reduce drying load at the edge and improve coating latitude at the edge but is not required in all applications. Wire support pin 22, blade/vacuum port combination 23, and lubricating liquid distribution body 36 are advantageously connected and supported by a support strut 34.

Issuing a flushing and lubricating liquid onto the edge guide is well known in the art. A low viscosity lubricating liquid minimizes the drag of the edge guide on the free-falling curtain and mitigates buildup of coating composition on the edge guide from congealing or drying.

Figure 5:
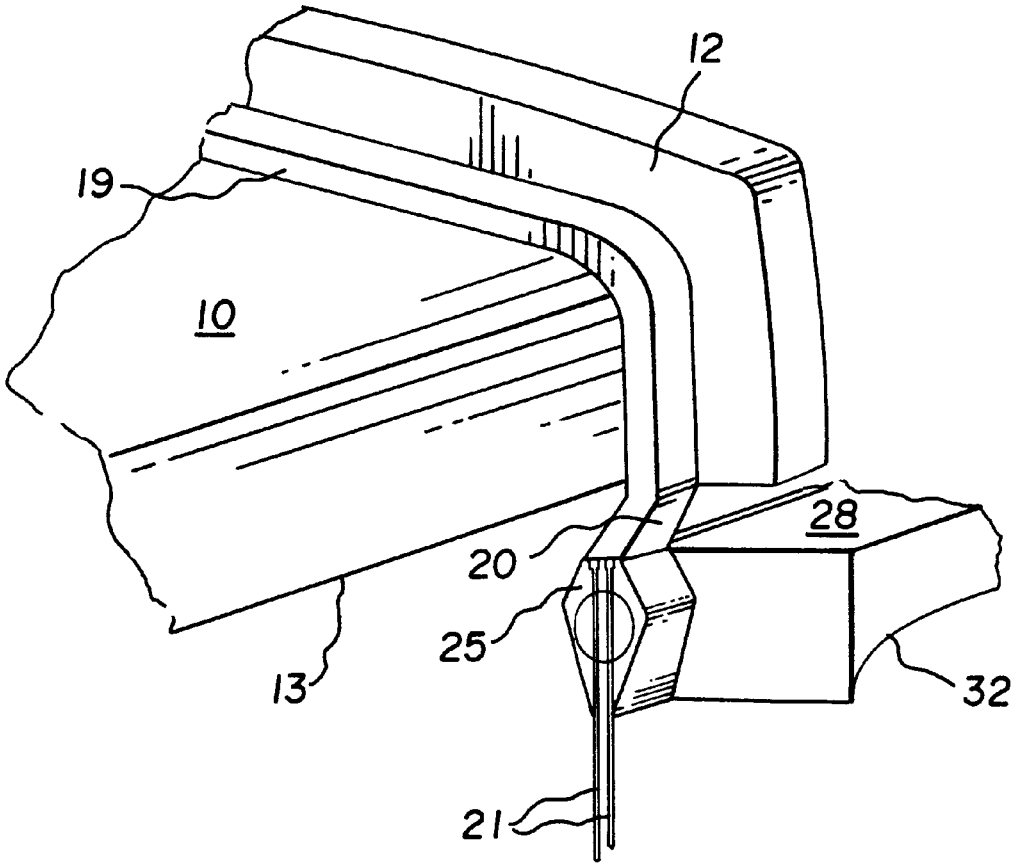
FIG. 5 shows a closer perspective view of the area of the edge guiding hardware in the region of the lubricating liquid distribution body.
Figure 6:
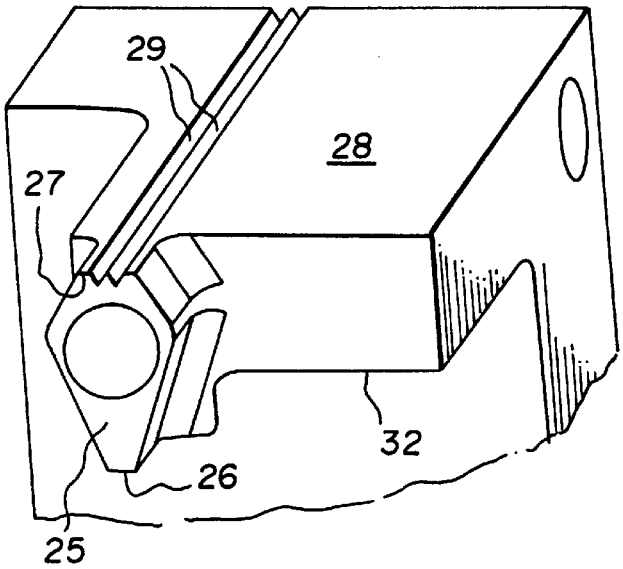
FIG. 6 shows a perspective view of an isolated distribution body.
Figure 7:
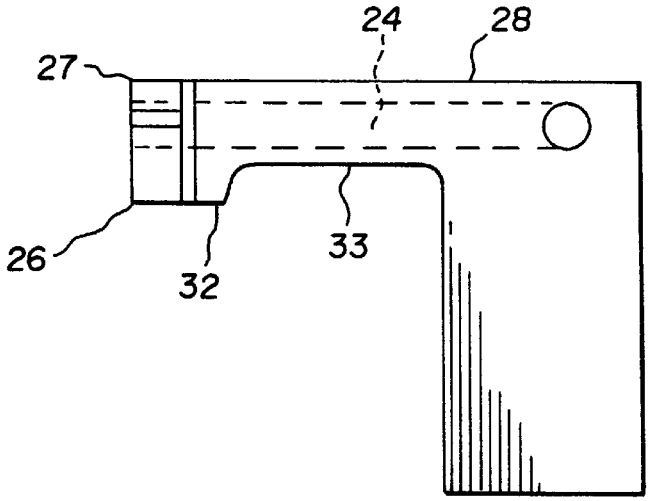
FIG. 7 shows the side of the isolated distribution body from a perspective normal to the plane of the curtain.

As seen in FIGS. 5, 6 and 7, the distribution body 36, according to the present invention, contains a conduit 24 of constant cross section. The conduit is preferably straight but may be slightly curved. It is substantially horizontal and its axis is parallel to lip 13. The shape of the cross section is circular or approximately circular in the sense that the aspect ratio of the cross section, defined as the ratio of the largest diameter to smallest diameter, is less than about 2. The length of the conduit of constant cross section preferably exceeds 2 centimeters. The horizontal diameter of the cross section exceeds the distance spanning the outermost edges of the wires. A horizontal diameter of about 2 to about 4 millimeters, such as 3 millimeters is preferred. The preferred flow rate for dual wire edge guides is about 0.5 cubic centimeter per second. Such a combination of flow rate and diameter ensures steady, laminar flow in the conduit and a momentum of the issuing stream low enough to avoid jetting into the main body of the curtain.

The outlet 37 of the conduit is preferably centered on and in nominal contact with the wires 21 of the edge guide as FIG. 5 shows. The thin wires pass across the outlet opening within its horizontal diameter but block just a small fraction of the opening. A land or face 25 surrounds the outlet of the conduit. This land lies in a vertical plane that is perpendicular to the hopper lip. The extent of the land in the horizontal direction is minimal, less than about 1 millimeter. The face gradually tapers in the upward and downward directions. In the downward direction, the face tapers over about 4 millimeters to a horizontal bottom edge 26 (FIGS. 6–8) of length less than or equal to the span of the outermost edges of the wires. In the upward direction, the face tapers over a small amount such as about 2 millimeters to a horizontal top edge 27 of length sufficient to support and position the wires of about 1 to about 3 millimeters, such as 2 millimeters is preferred. The top edge 27 can support the wires. Notches 29 in the top edge may be provided to position the wires.

The outer surface of the conduit over its final 2 or more millimeters of length is generated by translating the perimeter of the outlet face parallel to the axis so that the cross section of the conduit wall is constant over that distance. Beyond that distance, the distribution body of the curtain coating apparatus thickens to provide structural strength and attachment points.

The vertical distance between the hopper lip 13 and the bottom edge 26 of the face of the conduit opening is about 1 centimeter. Below 1 centimeter the curtain is in wetting contact with the edge guide wires alone until support pin 22 is reached.

Figure 8:
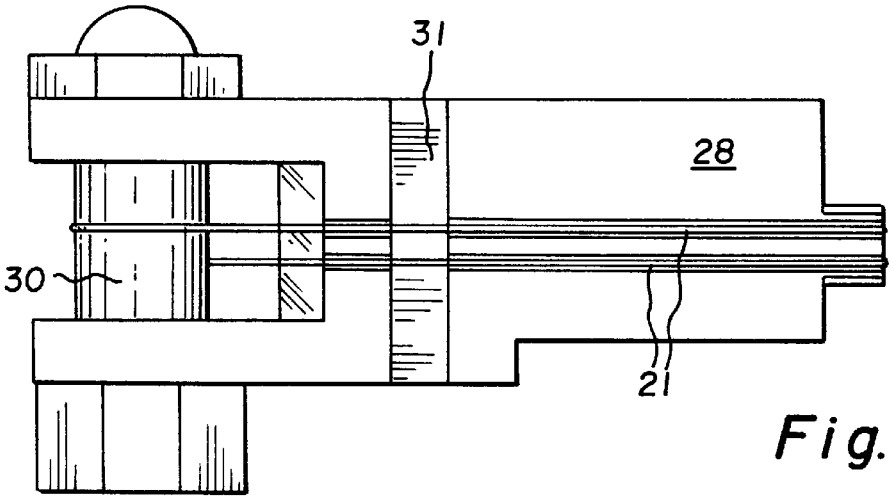
FIG. 8 shows the top of the isolated distribution body from a vertical perspective.

FIG. 8 shows that the top surface 28 of the distribution body 36 may contain notches 29 for guiding the edge guide wires 21 to tensioning bolts 30. Lubricating liquid may wick up the wires from the conduit opening toward the tensioning bolts and thereby create leaks. A sufficiently wide gap 31 in the top surface prevents wicking from continuing past the break.

Although one tensioning bolt 30 may be used to tension the wires, separate bolts are preferable because the tight turn of the wire at pin 22 can support a significant tension difference. Separate tensioning bolts ensure uniform tension in the wire. Inadequate tension results in the wires being drawn into contact by surface tension. A wire tension of about 20 Newtons is generally adequate to maintain the spacing of the wetted wires.

FIG. 7 shows that the bottom surface 32 of the body may also have a gap 33 to prevent liquid from the conduit opening from spreading to support strut 34. FIG. 6 shows a possible conduit supply hole 35. The cross-sectional area of the supply should be at least as large as that of the conduit so that jetting or turbulence is not introduced into the conduit.

Figure 9:
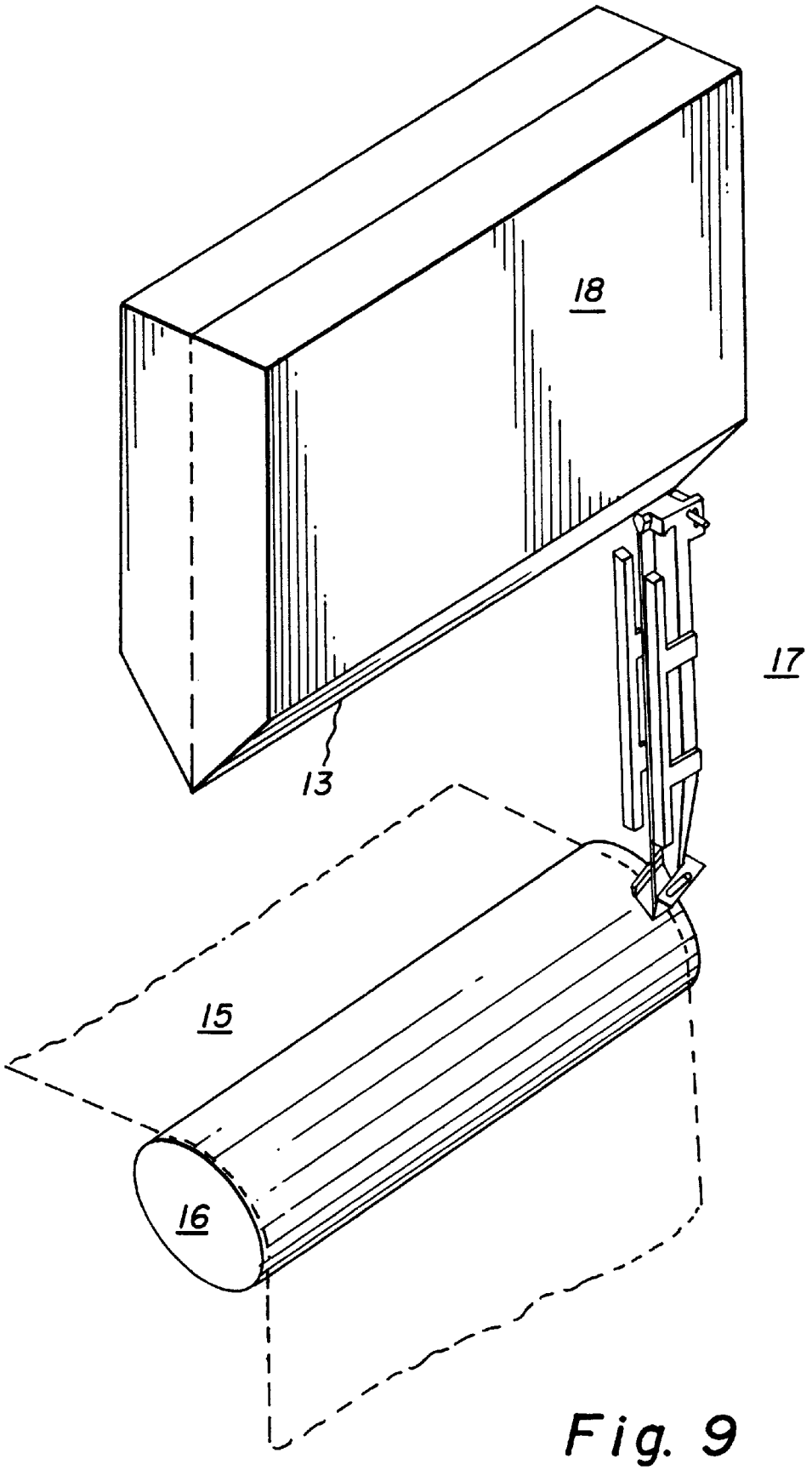
FIG. 9 is a perspective, schematic view of an extrusion-hopper curtain coating process incorporating the distribution body of the present invention.

The lubricating liquid distribution body of curtain coating apparatus of the present invention is not limited to use with a slide hopper. For example, FIG. 9 shows a schematic view of a coating apparatus incorporating the distribution body wherein a single-slot extrusion hopper 18 forms a curtain by issuing a single coating composition through a slot. In this case, because of the symmetry, the curtain always lies in a vertical plane, and the wires are vertical.

The face of the conduit is preferably planar and in nominal contact with the wires to mitigate standing waves. For a composite layer containing solvents of low volatility (e.g. water), this configuration preferred. However, for cases including a single coating composition containing highly volatile solvents that is highly concentrated, the buildup of coating composition on the face of the outlet may be limiting. In that case, it can be advantageous to create a gap of about 1 millimeter between the wires and a bottom section of land 25 contiguous with bottom edge 26.

EXAMPLE

Figure 1A:
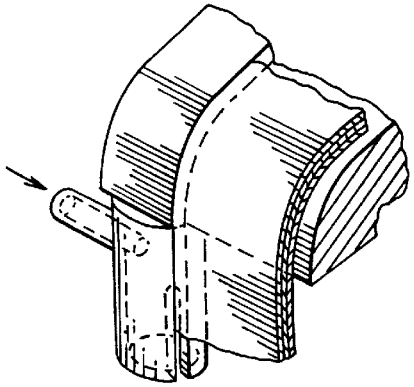
Fig. 1a PRIOR ART
FIGS. 1*a*–1*f* show distributors for edge-guide lubricating and flushing liquid according to the prior art.
Figure 1B:
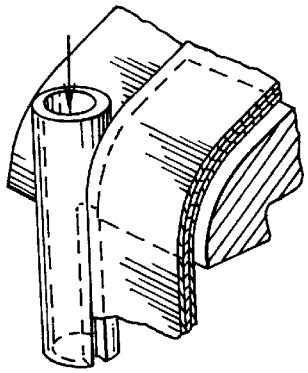
Fig. 1b PRIOR ART
Figure 1C:
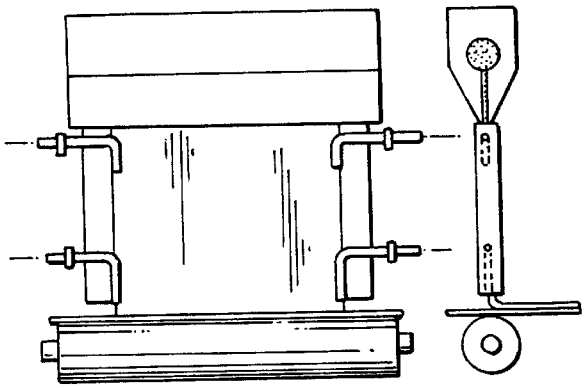
Fig. 1c PRIOR ART
Figure 1D:
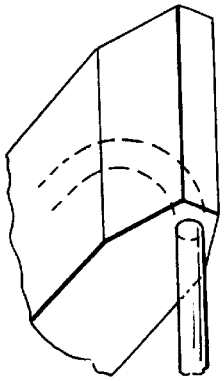
Fig. 1d PRIOR ART
Figure 1E:
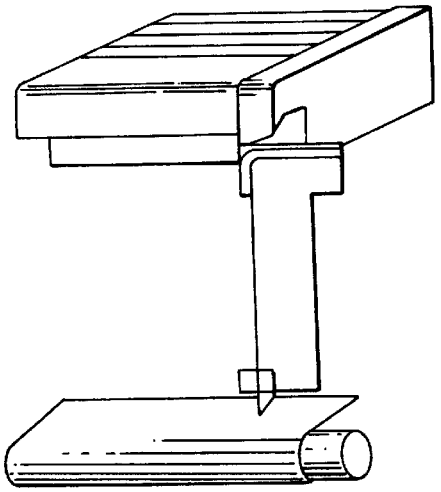
Fig. 1e PRIOR ART
Figure 1F:
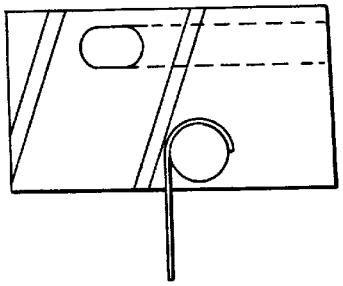
Fig. 1f PRIOR ART

An experiment was performed to demonstrate the advantages of the present invention. A composite layer of three aqueous coating compositions was formed by means of a slide hopper. The outermost layers, comprising gelatin, photographic emulsion, and surfactant, each had a viscosity of 0.28 poise and a flow rate of 0.28 cc/sec per centimeter of width. The middle layer of gelatin had a viscosity of 0.45 poise and a flow rate of 2.46 cc/sec per centimeter of width. Dual wire edge guides as described in U.S. Pat. No. 5,328,726 were used. The left edge guide employed a lubricating liquid delivery body of the prior art according to U.S. Pat. No. 5,358,569 and shown in FIGS. 1*e* and 2. The right edge guide employed a distribution body in accordance with the present invention. Specifically, the circular conduit had a diameter of 0.12 inches (3.0 mm) and a length of 0.9 inches (2.3 cm); the length of the bottom edge of the outlet face was 0.034 inches (0.86 mm) and its distance below the hopper lip was 0.38 inch (9.5 mm); the length of the top edge of the face was 0.068 inches (1.73 mm); the vertical distance between the top and bottom edges was 0.25 inches (6.4 mm); and the maximum horizontal span of the face was 0.15 inches (3.8 mm). The flow rate of the lubricating liquid, water, was varied between 0.3 and 0.5 cc/sec.

Figure 2:
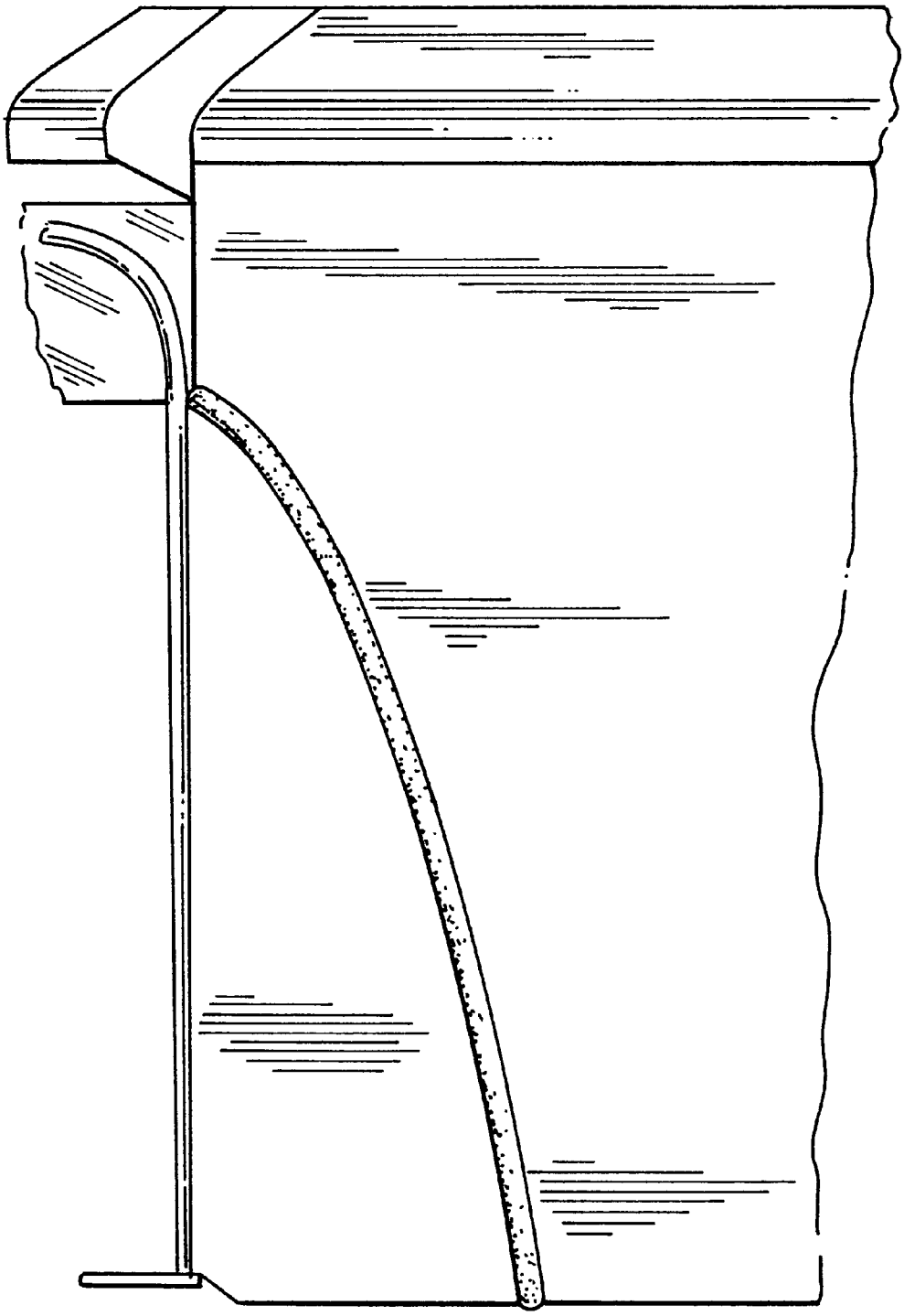
Fig. 2 PRIOR ART
FIG. 2 is a view normal to a curtain showing a stationary wave arising from a distribution body according to prior art.

It was observed that the lubricating liquid distribution body of the prior art initiated a prominent stationary wave at the location depicted in FIG. 2. On the other hand, the distribution body of the present invention did not initiate a perceptible stationary wave.

It is surprising that a lubricating liquid distribution body for which wetting contact with the curtain greatly exceeds the thickness of the curtain does not initiate stationary curtain waves. Over the remainder of the edge guiding hardware, the wetted distance normal to the composite layer is advantageously comparable to the local thickness of the composite layer. An explanation for this unexpected result is not known, and the advantages of the distribution body of the invention could not be anticipated by those skilled in the art.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

Parts List

10 hopper
11 slots
12 edge pad
13 hopper lip
14 curtain
15 receiving surface
16 coating roller
17 edge guides
18 extrusion hopper
19 guiding sidewall of edge pad
20 projection of the edge pad below the lip
21 wires
22 wire support pin
23 blade/vacuum port combination
24 conduit
25 land
26 bottom edge of land
27 top edge of land
28 top surface of distribution body
29 notches to locate wires
30 tensioning bolts
31 gap in top surface of distribution body
32 bottom surface of distribution body
33 gap in bottom surface of distribution body
34 support strut
35 conduit supply hole
36 lubricating liquid distribution body
37 outlet of conduit

What is claimed is:

1. A curtain coating apparatus for coating a composite layer comprising one or more of coating compositions onto a moving receiving surface comprising:

conveying means for moving said receiving surface along a path through a coating zone;

hopper means for forming a composite layer of one or more coating compositions;

hopper lip means terminating in a horizontal edge from which said composite layer detaches to form a free falling curtain extending transversely of said path and impinging on said receiving surface;

edge guide means spaced apart and substantially vertical comprising two straight wires in wetting contact with said curtain;

lubricating liquid distribution means for issuing a lubricating liquid onto said wires comprising:

supply means to provide a continuous flow of said lubricating liquid;

a substantially horizontal and straight cylindrical conduit with axial direction substantially parallel to said hopper lip and with horizontal diameter exceeding the distance between the outermost edges of said wires for conducting said lubricating liquid from said supply to said wires;

an outlet opening of said conduit nominally contacting said wires and positioned such that said wires pass across and within the horizontal diameter of said outlet opening;

a land surrounding said outlet lying substantially in a vertical plane perpendicular to said hopper lip and tapering downwards and terminating within about 1 centimeter of said hopper lip in a lower horizontal edge of length equal to or less than the distance between the outermost edges of said wires.

2. The apparatus according to claim 1 wherein said land additionally tapers upwards and terminates in a horizontal top edge.

3. The apparatus according to claim 2 wherein said top edge of said land supports said wires above said outlet opening.

4. The apparatus according to claim 3 wherein said top edge is notched to position said wires.

5. The apparatus according to claim 1 wherein the aspect ratio of the cross section of said conduit is less than 2.

6. The apparatus according to claim 5 wherein the horizontal diameter of said conduit is about 3 millimeters.

7. The apparatus according to claim 6 wherein said coating compositions are photographic emulsions and said solvent is water.

8. The apparatus according to claim 1 wherein the flow rate of said lubricating liquid is about 0.5 cubic centimeters per second.

9. The apparatus according to claim 1 wherein said hopper is a slide hopper with edge pad guiding surfaces in wetting contact with said coating compositions extending to said lip or up to 5 millimeters below said lip and terminating in nominal contact with said lubricating liquid distribution means.

10. The apparatus according to claim 1 wherein said lubricating liquid is a solvent for said coating compositions.

11. The apparatus according to claim 1 wherein said hopper extrudes said coating composition through a slot in said hopper.

12. The apparatus according to claim 1 wherein bottom of said edge guide is a pin supporting said wires.

13. The apparatus according to claim 1 wherein bottom of said edge guide is a blade/vacuum port combination.

* * * * *